US006554543B2

(12) United States Patent
Hodge

(10) Patent No.: US 6,554,543 B2
(45) Date of Patent: Apr. 29, 2003

(54) METHOD AND APPARATUS FOR IMPROVING THE STRUCTURE OF SATURATED MASSES OF GRANULAR MATERIALS

(76) Inventor: William E. Hodge, 207 West Hastings Street, #403, Vancouver, British Columbia (CA), V6B 1H7

( * ) Notice: Subject to any disclaimer, the term of this patent is extended or adjusted under 35 U.S.C. 154(b) by 48 days.

(21) Appl. No.: 09/866,392

(22) Filed: May 24, 2001

(65) Prior Publication Data

US 2002/0003989 A1 Jan. 10, 2002

Related U.S. Application Data

(60) Provisional application No. 60/207,106, filed on May 24, 2000.

(51) Int. Cl.[7] ..... F02D 3/02; B01F 11/00

(52) U.S. Cl. ..... 405/271; 366/123

(58) Field of Search ..... 405/271; 404/133.05, 404/133.1, 133.2, 113; 366/117, 120–123, 108

(56) References Cited

U.S. PATENT DOCUMENTS

| | | | | | |
|---|---|---|---|---|---|
| 1,989,409 | A | * | 1/1935 | Gordon | 366/123 |
| 2,719,029 | A | * | 9/1955 | Steuerman | 405/271 |
| 4,112,692 | A | * | 9/1978 | Anderson et al. | 405/271 |
| 4,664,557 | A | | 5/1987 | Hodge | |
| 5,150,988 | A | * | 9/1992 | Powell et al. | 405/271 |
| 5,282,699 | A | | 2/1994 | Hodge | |

FOREIGN PATENT DOCUMENTS

| | | | |
|---|---|---|---|
| CA | 1245468 | | 11/1988 |
| CA | 1338305 | | 5/1996 |
| JP | 60-73912 | * | 4/1985 |
| ZA | P. 15663 | | 7/1989 |

OTHER PUBLICATIONS

W. E. Hodge (1988) "Construction method for Improving Underwater Sand Fills" American Society of Civil Engineers, Geotechnical Division Specialty Conference on Hydralulic Fill Structures, Fort Collins.

R. G. Campanella, R. Hitchmen, and W. E. Hodge (1990) "New Equipment for DEnsification of Granular Soils at Depth" Canadian Geotechnical Journal, vol. 27, No. 2.

W. E. Hodge (1998) "Loquefiable Materials and their Treatment by Vibro–Draining" ISBN 0–921095–44–9.

* cited by examiner

*Primary Examiner*—Frederick L. Lagman

(57) ABSTRACT

An apparatus and method for improving the structure of saturated masses of granular materials. The apparatus comprises an axially elongated probe having a generally cylindrical side wall and upper and lower ends, the lower end being adapted to penetrate the mass, the side wall having a screen portion to restrict the passage of particles therethrough, and to pass water therethrough into a space within the probe. There is a vibrating member located within the probe and generally adjacent the screen portion to generate a vibrating force within a region of the mass. At least one impeller blade is located within the probe generally adjacent the vibrating member to generate a low pressure zone to draw the water from said region into the space. A discharge conduit communicates with the space associated with the screen portion and the conduit extends upwardly to the upper end of the probe. An air-lift pump is located at the upper end of the probe in communication with the discharge conduit to expel water from the space. A motor located within the probe and generally adjacent the vibrating member powers the vibrating member and the at least one impeller blade.

5 Claims, 3 Drawing Sheets

METHOD AND APPARATUS FOR IMPROVING THE STRUCTURE OF SATURATED MASSES OF GRANULAR MATERIALS

CROSS-REFERENCE TO RELATED APPLICATIONS

This application claims priority under 35 U.S.C 119(e) to U.S. Provisional Patent Application No. 60/207,106 filed May 24, 2000, the disclosure of which is incorporated herein by reference.

BACKGROUND OF THE INVENTION

1. Field of Invention

This invention relates to a method and apparatus for improving the structure of saturated masses of granular materials and more particularly to the prevention of liquefaction by actively withdrawing water from the granular mass while applying a vibratory force.

2. Description of Related Art

The concept of improving the engineering behaviour of weak and compressible sand deposits by inserting a vibrator into the ground has been used since the 1930s. It has been common practice since then to add water while applying vibration within the ground. This approach is commonly called "Vibroflotation".

In the past, the inventor has proposed a vibrodrain approach as a technical improvement on vibroflotation. In his Canadian patent No. 1,338,305 issued May 7, 1996, the disclosure of which is incorporated herein by reference, the inventor describes how deliberately extracting water from a granular mass, rather than adding water to the mass, at the same time it is being subjected to vibration, gave a better result in terms of improving the structure of the granular material. These masses of granular material can be either natural deposits of sands and silts; industrial wastes such as mine tailings or other two phase accumulations of discrete particles. The benefits associated with the vibrodrain technique include a reduction in the volume of the mass, increasing the shear strength of the mass and decreasing the compressibility of the mass. The above benefits can be achieved at virtually any depth within the body of the mass. By way of example, the vibrodrain technique finds particular application in the treatment of loose soils to prevent ground liquefaction during earthquakes such as occurred in the Marina district of San Francisco during the 1989 Loma Prieta earthquake. Ground improvement according to the vibrodrain technique would have avoided or reduced damage and losses. The vibrodrain technique is not limited to providing beneficial treatments to the materials and environment discussed above, but this provides a significant and readily understandable example of the benefits of the technique.

The inventor has previously developed tools to carry out the vibrodrain technique described above. These previous tools are disclosed in his U.S. Pat. No. 5,282,699 issued Feb. 1, 1994 and entitled Method and Apparatus for Densification of Sands or Silts, the disclosure of which is incorporated herein by reference.

Currently available vibrodrain tools rely on two separate modules, one specifically for producing vibrations, another for withdrawing water from the ground. The drain is stacked on top of the vibrator with the intake of the drain some seven feet above the centre of the vibrator. Vibration is achieved by rotation of an eccentric weight. High pressure air flow is used to purge the drainage water from the system utilizing the venturi effect. Using air rather than a mechanical pumping system allows grit laden water to be handled with reduced wear of components.

Current vibrodrain tools suffer from the following constraints on performance:

The fact that the drain intake is situated above the vibrator means that once the drainage module rises above the watertable, the benefit of concurrent drainage and vibration is lost. This means that the top seven feet or so of saturated ground do not receive the full benefits of the vibrodrain technique.

In cases where water flow rates are low, expansion of the high pressure air flow delivered as highly compressed air causes freezing of the water resulting in blocking of the outlet conduit used to drain away water, thereby essentially nullifying, or severely curtailing the benefits of drainage.

SUMMARY OF THE INVENTION

To address the above shortcomings, the present invention provides a novel vibrodrain tool and method that employs a single module for both producing vibrations and for withdrawing water from the ground. The vibrodrain tool of the present invention places the drainage intake at substantially the same level at the vibrator so that the influence of vibration and drainage are concentrated in the same area.

Instead of relying on the venturi effect to drain water, the vibrodrain tool and method of the present invention rely on a mechanical impeller system to extract water from a granular mass during vibration of the region.

In accordance with one aspect of the invention, there is provided a method of improving the structure of saturated masses of granular materials. The method may involve generating and applying within a region of said mass a vibratory compacting force generally adjacent a source of the force and during generation and application of said force, activating an impeller blade adjacent the source of the vibratory force to produce a low hydraulic pressure sink to draw water from said region into a space generally adjacent the source of the vibratory force.

In accordance with another aspect of the invention there is provided an apparatus for improving the structure of saturated masses of granular materials, comprising:

a) an axially elongated probe having a generally cylindrical side wall and upper and lower ends, the lower end being adapted to penetrate the mass, the side wall having a screen portion to restrict the passage of particles therethrough, and to pass water therethrough into a space within the probe;

b) a vibrating member located within the probe and generally adjacent the screen portion to generate a vibrating force within a region of said mass;

c) at least one impeller blade located within the probe generally adjacent the vibrating member to generate a low pressure zone to draw the water from said region into the space;

d) a discharge conduit communicating with the space associated with the screen portion, the conduit extending upwardly to the upper end of the probe;

e) an air-lift pump located at the upper end of the probe in communication with the discharge conduit to expel water from the space; and a motor located within the probe and generally adjacent the vibrating member to power the vibrating member and the at least one impeller blade.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Aspects of the invention are illustrated, merely by way of example, in the accompanying drawings in which.

DETAILED DESCRIPTION OF THE PREFERRED EMBODIMENTS

Figure 1:
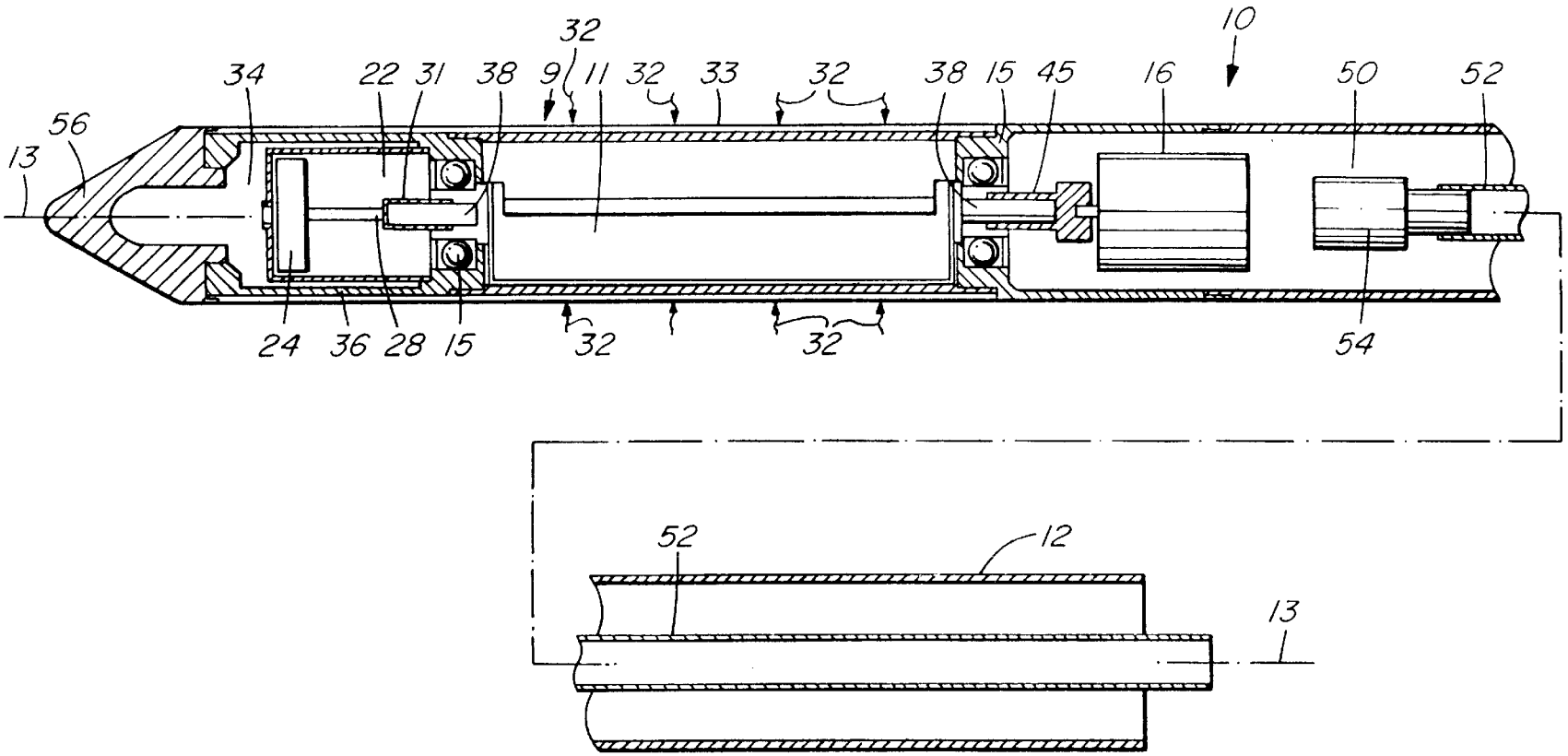
FIG. 1 is a section view through a preferred embodiment of the apparatus of the invention.

Referring to FIG. 1, an apparatus according to a preferred embodiment of the invention is shown generally at 10. The active portion of the apparatus is attached to the end of a simple probe or tube member 12, preferably formed from steel. The tube member provides a conduit for hydraulic motor hoses, compressed air lines (not shown) that extend from the active portion. The active portion preferably includes a generally conical nose cone 56 to assist in penetration of the tool into a mass of granulated particles.

The active portion of the apparatus relies on a hydraulic motor 16 to drive a vibrator 9. Preferably, the vibrator comprises an eccentric weight 11 that is rotated by motor 16. A pump housing 22 encases one or more impeller blades 24 which act as a water pump when caused to rotate in unison with the eccentric weight.

Figure 2:
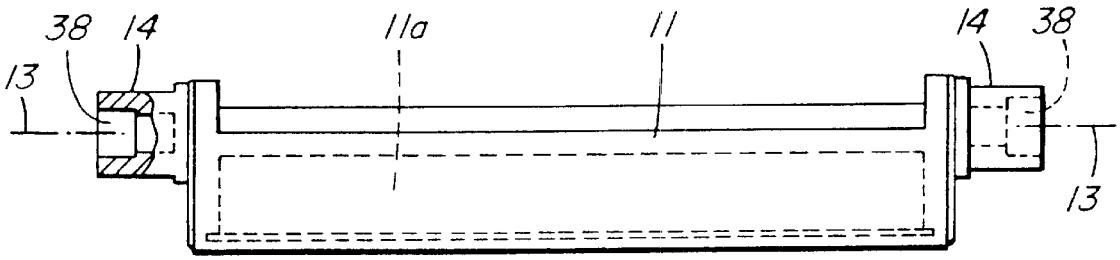
FIG. 2 is a detail view of the eccentric weight used in the apparatus.

As best shown in FIG. 2, eccentric weight 11 preferably comprises a semi-cylindrical mass 11*a* with a missing section such that the centre of mass of the weight is offset from the longitudinal axis 13 of the apparatus. The ends of weight 11 include coaxial hubs 14 mountable in bearings 15 within tube 12 to permit rotation of the weight. Preferably, weight 11 is formed with a lead core to make the weight as massive as possible within a relatively small volume.

Figure 4:
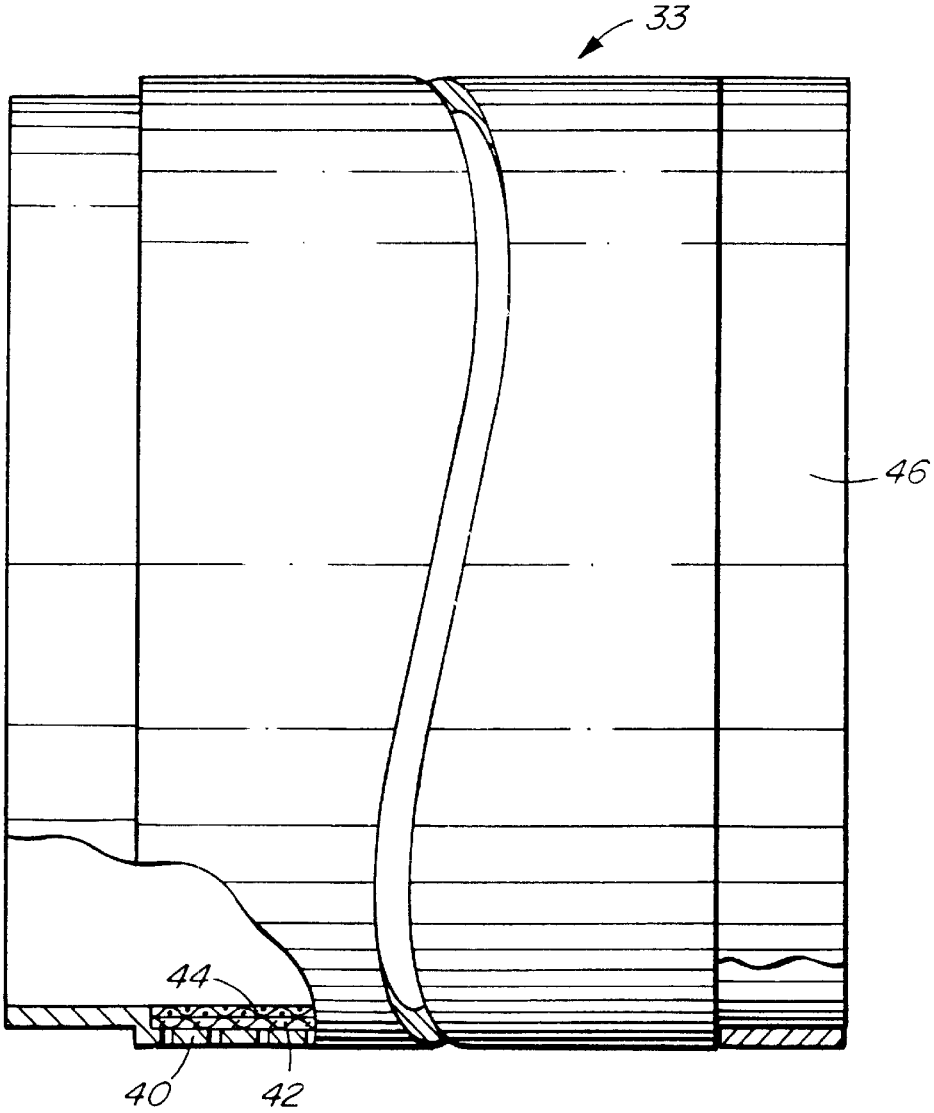
FIG. 4 is a detail view of the filter element.

As best shown in FIG. 1, water from the region surrounding the apparatus 10 is drawn into the interior of tube 12 through a filtered screen 33 which prevents solid particles from entering the apparatus. The flow of water is indicated by arrows 32. Filtered screen 33 surrounds eccentric weight 11 to ensure that the vibration generated by rotation of the weight is adjacent the drainage region for the tool. As best shown in FIG. 4, screen 33 preferably comprises a perforated steel tube 40. Inner filtering elements preferably include an intermediate woven fabric layer 42 and an inner wire mesh layer 44 to minimize the entry of solid particles. Alternative materials and layer arrangements are possible and will be readily apparent to a person skilled in the art. An end of filtered screen 33 is mounted to the outer surface of one of the bearings 15 by retaining strap 46.

Figure 3:
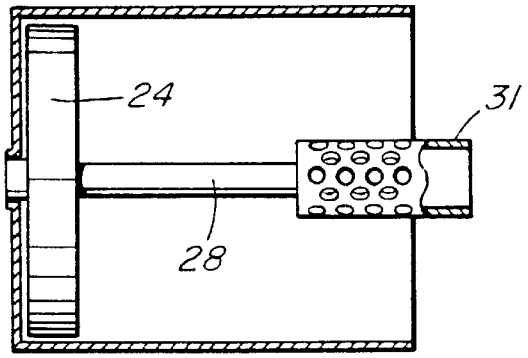
FIG. 3 is a detail view of the impeller pump element.
Figure 3A:
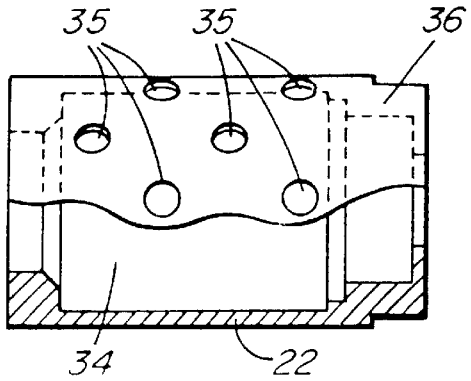
FIG. 3*a* is a detail view of the impeller pump housing.

Water passes through screen 33 and travels downwardly to enter pumping compartment 34 through filtering perforations 35 in the outer casing 36 of the pump housing (see FIG. 3*a*). Preferably, perforations 35 are 1 inch in diameter and angularly displaced by 60 degrees about the diameter of the casing. Adjacent rows of perforations are spaced 2 inches apart and staggered at 30 degrees.

As best shown in FIG. 3, one or more sets of impeller blades 24 are rotatably mounted within pump housing 22 to form a single or multiple stage impeller pump supported on shaft. The pump is preferably sized to be able to deliver 100 gallons per minute at a pump speed of 1500 rpm and a pressure under 15 psi.

Impeller blades 24 are mounted to a central shaft 28 which terminates in a hollow cylinder 31. Cylinder 31 is formed with an array of perforations to permit the access of water pumped by blades 24 into the interior of the cylinder. The perforations are preferably ¼ inch in diameter and angularly displaced by 60 degrees within a row about the surface of cylinder 31. Adjacent rows of perforations are spaced ½ inches apart and staggered by 30 degrees.

Referring to FIG. 1, impeller blades 24 are mounted via shaft 28 and cylinder 31 to a hollow shaft 38 which extends through hubs 14 and eccentric weight 11. Thus, water pumped by impeller blades 24 to cylinder 31 passes through shaft 38 to the other side of eccentric weight 11 adjacent hydraulic motor 16. Shaft 38 is driven by hydraulic motor 16 and serves the dual function of a conduit for water and a drive shaft to rotate eccentric weight 11 and impeller blades 24. Preferably, hydraulic motor 16 is an axial-piston model having axially aligned ports. The motor preferably has a capacity of about 10 hp and a maximum speed of 2500 rpm.

The water emerges from hollow shaft 38 through slots in the upper portion of shaft 38. Shaft 38 is received in a coupling 45 just below hydraulic motor 16 which drivingly connects shaft 38 to motor 16.

An air-lift pump 50 consisting of a tube 52 with an attached air inlet nozzle 54 is preferably provided to remove the water from the apparatus 10 to a receptacle at ground level (not shown for ease of illustration). The air-lift pump can only operate if the tip of the apparatus is adequately submerged. This requirement is met by the lower impeller pump which produces sufficient head to elevate the drain water potential well above the tip level.

The apparatus of the present invention relies on the impeller blades 24 and the vibrator 9 being driven by the same motor. The air lift pump 50 is made to work by a low-compression, low-flow air compressor. The air lift pump 50 is therefore a separate component that can operate independently of the vibrator.

The apparatus of the present invention provides an efficient, compact and reliable tool for improving the structure of a saturated mass of granular particles by removing water and vibration of the particles. The active length of the tool of the present invention has been halved as compared to conventional vibrodrain equipment without any increase in diameter. It is now possible to evacuate drainage water using low pressure and low volume air flow by the introduction of an impeller pump below the vibrator unit. This innovation provides the tip submergence necessary to allow for an air-lift pump to be used. The impeller pump is rotated by an extension of the vibrator shaft so that the need for a separate pump motor is eliminated. Water is drawn into the tool by the action of the vibrator-driven impeller, and enters at the lowest possible level. The water drawn into the system is then passed to the air-lift intake which is located on the other side (top) of the vibrator through the drive shaft which is hollow to accept the flow. In order to allow the hollow shaft to co-exist within the eccentric weight without any loss of generated vibration energy, the bulk of the material from which the weight is made lead. The lead is preferably encased in steel to isolate it from the water. At the same time, the introduction of this denser metal allows the eccentric weight diameter to be reduced sufficiently that a filtered intake can be placed around the vibrator without increasing the overall diameter of the tool.

Operation

In order to improve the saturated mass, the apparatus 10 is inserted into the mass in a sequence of vertical applications arranged on a grid pattern. The apparatus 10 is usually carried from one location to another by a tracked vehicle such as a backhoe. The motor 16 can be powered by the surplus capacity of the backhoe's hydraulic system. At each grid point the apparatus 10 is inserted to the desired depth (typically about 60 feet). Normally the apparatus 10 sinks into the ground under its own weight over the nose cone 56 once vibration forces are generated.

As vibration forces are being generated by vibrator 9, impeller blades 24 are also activated. Water is drawn into the apparatus 10 by the action of impeller blades 24, and enters the apparatus 10 through the screen 33 and on into the pumping compartment 34. While the apparatus 10 is operational, it is lifted out of the mass in a step-wise fashion. This procedure is repeated at each of the grid points. The desired degree of ground improvement is achieved by proper choice of grid spacing and withdrawal rate.

While specific embodiments of the invention have been described and illustrated, such embodiments should be considered illustrative of the invention only and not as limiting the invention as construed in accordance with the accompanying claims.

I claim:

1. A method of improving the structure of saturated masses of granular materials, comprising the steps of:

a) generating and applying within a region of said mass a vibratory compacting force generally adjacent a source of the force; and b) during generation and application of said force, activating an impeller blade adjacent the source of the vibratory force to provide a low pressure zone to draw water from said region into a space generally adjacent the source of the vibratory force.

2. The method of claim 1 further comprising the step of expelling the water from the space through a conduit and an air-lift pump.

3. An apparatus for improving the structure of saturated masses of granular materials, comprising:

an axially elongated probe having a generally cylindrical side wall and upper and lower ends, the lower end being adapted to penetrate the mass, the side wall having a screen portion to restrict the passage of particles therethrough, and to pass water therethrough into a space within the probe;

a vibrating member located within the probe and generally adjacent the screen portion to generate a vibrating force within a region of said mass;

at least one impeller blade located within the probe generally adjacent the vibrating member to generate a low pressure zone to draw the water from said region into the space;

a discharge conduit communicating with the space associated with the screen portion, the conduit extending upwardly to the upper end of the probe;

an air-lift pump located at the upper end of the probe in communication with the discharge conduit to expel water from the space; and a motor located within the probe and generally adjacent the vibrating member to power the vibrating member and the at least one impeller blade.

4. The apparatus of claim 3 wherein the vibrating member is an eccentrically mounted weight adapted to rotate about a drive shaft generally parallel to a longitudinal axis of the probe.

5. The apparatus of claim 4 wherein the drive shaft is adapted to serve as the discharge conduit.

* * * * *